United States Patent [19]

Ray et al.

[11] Patent Number: 4,618,740

[45] Date of Patent: Oct. 21, 1986

[54] ELECTRICAL OUTLET SAFETY DEVICE

[76] Inventors: Edgar C. Ray, Rte. 2, Box 137, Buffalo Lake, Minn. 55314; William A. Kohl, P.O. Box 1154, Marshall, Minn. 56258

[21] Appl. No.: 795,529

[22] Filed: Nov. 6, 1985

[51] Int. Cl.[4] ..... H01R 13/44

[52] U.S. Cl. ..... 174/67; 339/36; 428/40; 428/138; 428/317.1

[58] Field of Search ..... 174/67; 339/36, 37; 428/40, 138, 317.1, 317.5

[56] References Cited

U.S. PATENT DOCUMENTS

| | | | |
|---|---|---|---|
| 3,147,055 | 9/1964 | Rubens | 339/36 |
| 3,201,740 | 8/1965 | Rubens | 174/67 X |
| 3,543,218 | 11/1970 | Archer | 339/74 |
| 3,810,070 | 5/1974 | Ludwig | 339/36 |
| 4,076,360 | 2/1978 | Singh | 339/36 |
| 4,257,659 | 3/1981 | Gibbs | 339/36 |
| 4,293,173 | 10/1981 | Tricca | 339/38 |
| 4,293,733 | 10/1981 | Royer | 174/67 |
| 4,312,458 | 1/1982 | Stewart | 220/241 |

*Primary Examiner*—Alexander S. Thomas

*Attorney, Agent, or Firm*—Schroeder & Siegfried

[57] ABSTRACT

Disclosed is an aesthetically pleasing, inexpensive safety device that protects children from electrical shock from electrical outlets that have, or do not have, devices connected thereto. The safety device adhesively secures an impermeable cover over an unused electrical outlet to prevent the insertion of foreign objects by a child. In outlets with an electrical appliance connected, the impermeable cover is removed and the safety device holds the electrical plug to the electrical receptacle, preventing partial removal of the plug.

4 Claims, 8 Drawing Figures

ELECTRICAL OUTLET SAFETY DEVICE

BACKGROUND OF THE INVENTION

The present invention relates to a safety device for electrical outlets of the type that receive the prongs of a plug of an electrical cord which lead from a connecting electrical appliance. More particularly, the invention is directed to a safety device designed to protect children from electrical shock. The safety device protects against accidental electric shock from both electrical outlets that have or electrical outlets that do not have electrical appliances connected thereto.

Protecting children from the dangers associated with electrical receptacles is not an easy task. Most home electrical outlets are positioned low on the wall and therefore are readily accessible to small children. Since electrical appliance plugs necessarily project outwardly into a room from the wall outlet with the corresponding electrical cord trailing behind, the temptation of children to remove will be omnipresent. For unused electrical outlets the electric prong openings create a danger from the insertion of foreign objects such as hair pins, fingers, toys, scissors or other instruments. A partially removed electrical plug creates a grave danger of electrocution when the prongs are touched by a child.

In an attempt to alleviate some of the dangers, certain devices have been conceived as a measure to discourage children from playing with such electrical outlets or associated electrical appliance plugs. One such device is a plastic plug with a flat face and two male prongs, the entire device being composed of a non-conducting material. This later device is designed to be inserted in an unused electrical outlet to discourage or keep children from putting foreign objects into the female receptacles to avoid electrical shock. One of the limitations of such a device is that children can sometimes pry them out of the outlet and thereby negate its utility. Such insertable devices or plugs can not be used to protect children against prying out an already inserted electrical appliance plug and manipulating it to the partially unplugged position, creating the danger as discussed above.

To protect children from electrical shock from electrical outlets having or not having devices connected thereto, there is needed an inexpensive, easy to use, yet effective device. The device must be inexpensive so people will purchase it. It must be easy to use requiring little or no retrofitting to the electrical outlet. The effectiveness must be sufficient to warrant its use. As a result of the present need, the subject device was conceived.

SUMMARY OF THE INVENTION

The present invention provides a safety device to prevent electrical shock from electrical outlets that have or do not have devices connected thereto. The safety device is a two-sided adhesive core with a peel-away backing and an impermeable removable front cover. The core section is comprised of a tear resistant resilient material having sufficient thickness to conform to an electrical outlet. The core contains an adhesive which holds its adhesiveness qualities over an extended period of time and repeated uses. The core has openings corresponding to the electrical receptacle to which it will be attached.

In use the peel-away backing is removed from the adhesive core and the safety device attached to an electrical outlet. The safety device secures the impermeable front core over the electrical outlet. When it is desired to use an outlet the removable front cover is peeled away and an electrical plug inserted. The safety device secures the plug into the electrical outlet. Removal of the plug requires a great deal of force to break the adhesive bond between the safety device and the plug. Once the adhesive bond is broken the electrical plug will be completely removed and not remain in the dangerous condition of being partially inserted.

DESCRIPTION OF THE PREFERRED EMBODIMENT

Figure 1A:
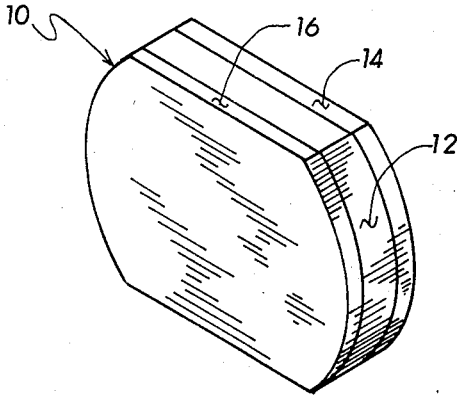
FIGS. 1*a*, 1*b*, and 1*c* are front, back, and side views of the present invention.
Figure 1B:
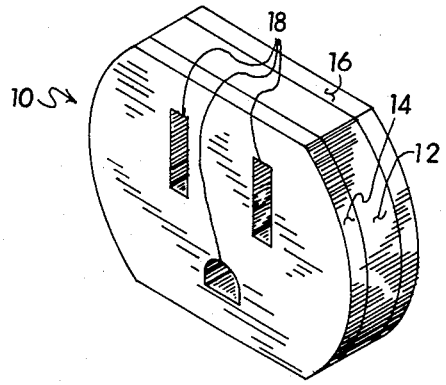
Figure 1C:
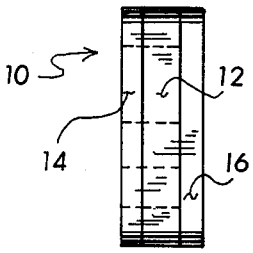

Referring now to the drawings, wherein like reference numerals refer to the like or corresponding parts throughout the several views, FIGS. 1*a*, 1*b*, and 1*c* show respectively the front, back and side views of the present invention. The electrical outlet safety device 10 of FIG. 1*a* comprises an adhesive core 12 having a peel-away backing 14 and a removeable impermeable front cover 16. The overall design of the safety defice is of a size and shape to match the electrical outlet to which it will be attached. As shown in FIG. 1*b* both the adhesive core 12 and the peel-away backing 14 have openings 18 corresponding to openings in a female electrical receptacle adapted for the insertion of an electrical appliance plug prongs. Only the adhesive core 12 requires these openings for insertion of the electrical plug because the peel-away backing 14 is removed prior to attachment of the safety device. The peel-away backing 14 is shown with the openings because of ease of manufacture.

The adhesive core 12 is made up of a tear resistant resilient material such as a cloth type tape similar to carpet tape. The thickness of the material must be sufficient to allow the adhesive core to conform to the shape of a standard electrical outlet to securely bond the safety device to the outlet. The adhesive quality of the core must last over an extended period of time and be capable of withstanding repeated use. When used in an electrical outlet having an electrical plug the adhesive core must withstand the tearing effect of the removal of the plug. To form the adhesive core, a foam tape, such as 3M's (TM) mounting tape, catalog no. 114, St. Paul, Minn. 55144, can be surrounded by a professional grade of two-sided cloth carpet tape available from Custom Tape, Inc., Chicago, Ill. 60656. This provides a durable tear resistant exterior over a comformable foam center.

Figure 2:
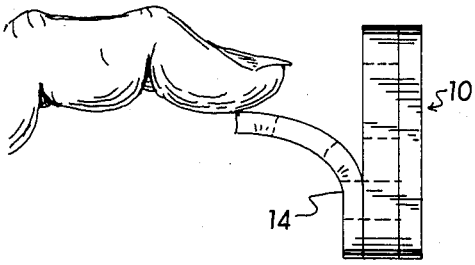
FIG. 2 illustrates the removal of the peel-away backing.
Figure 3:
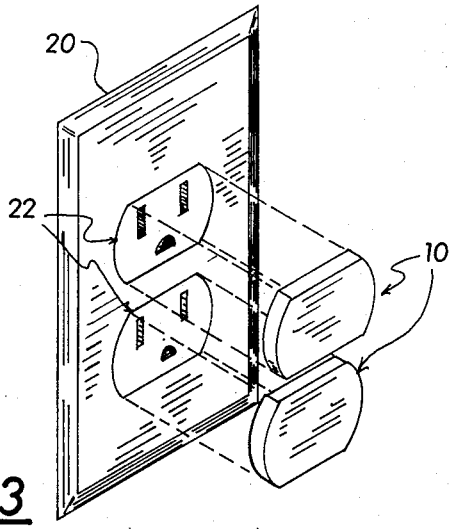
FIG. 3 illustrates the engagement of the safety device to an electrical outlet.

Referring to FIG. 2, the electrical outlet safety device is attached to an outlet by peeling away backing 14 from the adhesive core 12. Next the outer perimeter of the safety device 10 is aligned to the female receiving portion of an electrical receptacle 22 in a standard electrical outlet 20 as shown in FIG. 3. When pressed in place the safety device 10 adhesively bonds itself to the female electrical receptacle 22. With its impermeable front cover 16 still in place the safety device 10 prevents the insertion of foreign objects such as hair pins, fingers, toys, or other instruments into the electrical outlet.

Figure 4:
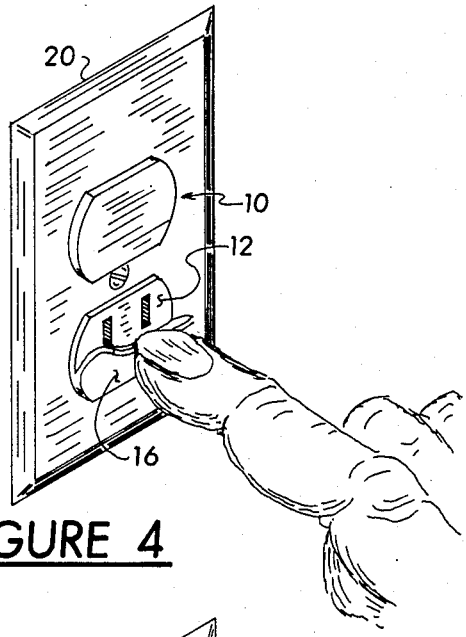
FIG. 4 illustrates the removal of the impermeable front cover of the safety device.
Figure 5:
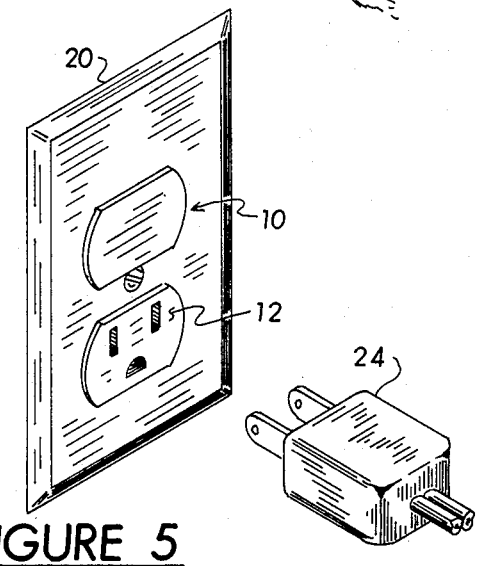
FIG. 5 illustrates an electrical outlet employing the present invention prior to the insertion of an electrical plug.

When it is desired to use a safety protected outlet, the removeable front cover 16 is removed, leaving only the adhesive core 12 as shown in FIG. 4. Electrical plug 24 as shown in FIG. 5 can now be readily inserted into the electrical outlet 20.

Figure 6:
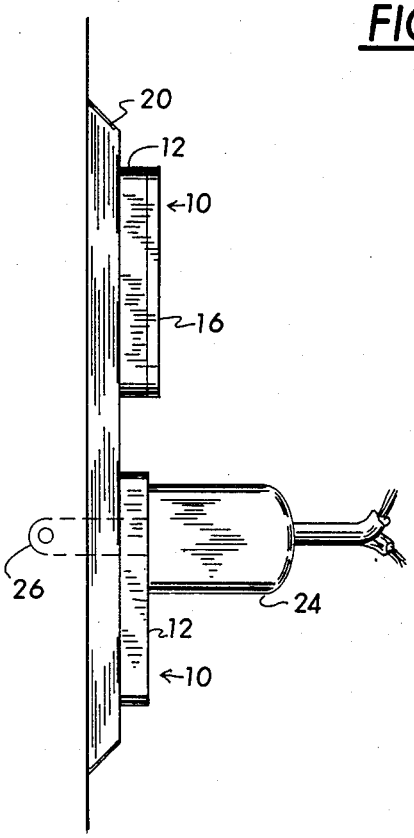
FIG. 6 is a side view employing the present invention on an electrical outlet having both a device connected and not having a device connected.

FIG. 6 is a side view of a typical electrical outlet 20 containing two female electrical receptacles one having a device connected thereto and one without. The top portion of FIG. 6 shows an electrical outlet safety device 10 in place with the adhesive core 12 securely fastened over outlet 22 and impermeable front cover 16 still in place. The lower portion of FIG. 6 shows a used electrical outlet with safety device 10 comprising adhesive core 12 securely fastened to the female portion of an electrical outlet into which the electric plug prongs 26 have been inserted. The adhesive core 12 securely fastens electrical appliance plug 14 to outlet 20.

To remove electrical appliance plug 24 from outlet 20 requires the breaking of the adhesive bond between the plug and the electrical outlet. To break the adhesive bond requires a strong initial force. Once the bond is broken the applied force will be sufficient to completely remove the plug and its associated male prongs 26 completely out of the female electrical receptacle. Therefore, the potentially dangerous condition of a partially inserted plug is greatly reduced.

What is claimed is:

1. A safety device for attachment to an electrical outlet comprising:

an adhesive core comprising a tear resistant resilient material, the adhesive core having openings and a general size and shape corresponding to the electrical outlet to which it is to be attached, the adhesive core capable of securing a male electrical plug to a female electrical outlet, the adhesive core having a first and a second surface;

a peel-away backing mated to the first surface of the adhesive core, and protecting the first surface of the adhesive core, to be peeled away prior to attachment of the safety device to an electrical outlet; and a front cover mated to the second surface of the adhesive core, the front cover adhesively secured to the adhesive core, the front cover impermeable to the insertion of objects into the female electrical outlet, the front cover removable to allow insertion of the male electrical plug.

2. The safety device of claim 1 wherein the peel-away backing has openings corresponding to the openings in the adhesive core.

3. The safety device of claim 1 wherein the adhesive core comprises a cushioned center surrounded by a two-sided adhesive cloth tape.

4. The safety device of claim 3 wherein the adhesive core comprises a double-sided adhesive foam tape center surrounded by a two-sided adhesive cloth tape.

* * * * *

UNITED STATES PATENT AND TRADEMARK OFFICE

CERTIFICATE OF CORRECTION

PATENT NO. : 4,618,740

DATED : Oct. 21, 1986

INVENTOR(S) : Edgar C. Ray et al

It is certified that error appears in the above-identified patent and that said Letters Patent is hereby corrected as shown below:

Column 3, Line 25 The number "14" should be --24--.

Signed and Sealed this

Thirteenth Day of January, 1987

*Attest:*

DONALD J. QUIGG

*Attesting Officer*

*Commissioner of Patents and Trademarks*